US009440722B2

(12) United States Patent
Lin

(10) Patent No.: US 9,440,722 B2
(45) Date of Patent: Sep. 13, 2016

(54) MARINE PROPELLER WITH ADJUSTABLE EXHAUST MEANS

(71) Applicant: SOLA SCIENCE & ENGINEERING CO., LTD, Taichung (TW)

(72) Inventor: Yeun-Junn Lin, Taichung (TW)

(73) Assignee: SOLAS SCIENCE & ENGINEERING CO., LTD., Taichung (TW)

( * ) Notice: Subject to any disclaimer, the term of this patent is extended or adjusted under 35 U.S.C. 154(b) by 377 days.

(21) Appl. No.: 13/963,659

(22) Filed: Aug. 9, 2013

(65) Prior Publication Data

US 2014/0248158 A1 Sep. 4, 2014

(30) Foreign Application Priority Data

Mar. 1, 2013 (TW) ..... 102107333 A

(51) Int. Cl.

| | |
|---|---|
| ***F04B 25/00*** | (2006.01) |
| ***B63H 20/26*** | (2006.01) |
| ***B63H 1/28*** | (2006.01) |
| ***B63H 1/20*** | (2006.01) |

(52) U.S. Cl.

CPC ..... *B63H 20/26* (2013.01); *B63H 1/20* (2013.01); *B63H 1/28* (2013.01)

(58) Field of Classification Search

CPC ..... B63H 1/20; B63H 1/28; B63H 20/26
USPC ..... 416/93 A, 244 B, 245 A, 246, 247 A
See application file for complete search history.

(56) References Cited

U.S. PATENT DOCUMENTS

| | | | |
|---|---|---|---|
| 5,916,003 A | 6/1999 | Masini et al. | |
| 6,375,528 B1 * | 4/2002 | Neisen | B63H 20/26 440/89 A |

* cited by examiner

*Primary Examiner* — Ching Chang
(74) *Attorney, Agent, or Firm* — Muncy, Geissler, Olds & Lowe, P.C.

(57) ABSTRACT

A marine propeller having multiple adjustable exhaust structures is disclosed. Each adjustable exhaust structure includes an exhaust unit with exhaust through holes cut through the outer surface and inner surface of the propeller hub of the marine propeller, an adjustment member with shielding portions mounted in the exhaust unit, and a fastening member for locking the adjustment member to the exhaust unit. The adjustment member is movable to adjust the shielding area of the shielding portions relative to the exhaust through holes when disengaged from the constraint of the fastening member. Thus, the exhaust volume is adjustable to fit different conditions without changing any component parts of the marine propeller, facilitating ease of use of the marine propeller.

5 Claims, 15 Drawing Sheets

MARINE PROPELLER WITH ADJUSTABLE EXHAUST MEANS

BACKGROUND OF THE INVENTION

1. Field of the Invention

The present invention relates to marine propellers, and more particularly to a marine propeller equipped with adjustable exhaust structures for allowing adjustment of exhaust volume.

2. Description of the Related Art

U.S. Pat. No. 5,916,003 discloses a propeller device, which comprises a propeller body with a propeller hub having 4 propeller blades extending therefrom and an aperture on each propeller blade, and a plug having a diametric profile shaped to be received and retained within each aperture. The vent plugs are provided with openings therethrough so that fluids can flow from a passage within a hub of the propeller device to a region proximate the outer cylindrical surface of the hub. The plugs can be changed to modify the size of the ventilation aperture without having to change the propeller device itself.

The propeller device is driven by an engine to move the propeller blades through water, achieving propeller thrust and forcing the boat to move forwards. At the same time, waste engine gas enters the passage of the propeller hub. At this time, a part of waste engine gas is exhausted through the ventilation aperture. Thus, the ventilation apertures of the plugs assist lowering the internal air pressure of the passage of the propeller hub, reducing water pressure from the propeller blades and enhancing propelling speed of the propeller blades.

However, under different application conditions, such as different water level, load, temperature, and etc., the user must selectively use different sizes of plugs having different dimensions of ventilation apertures, or plugs without any ventilation aperture to adjust the exhaust volume of the propeller device to an optimal condition for better propeller performance.

In other words, the user must provide different sizes of plugs having different dimensions of ventilation apertures for use in different conditions. Preparing a large number of plugs relatively increases the cost. Further, the plugs can get lost easily when not in use. Therefore, the aforesaid prior art design of propeller device is not convenient to use.

SUMMARY OF THE INVENTION

The present invention has been accomplished under the circumstances in view. It is the main object of the present invention to provide a marine propeller, which allows convenient adjustment of the exhaust volume without changing any component parts, facilitating ease of use.

To achieve this and other objects of the present invention, a marine propeller comprises a propeller body. The propeller body comprises a propeller hub and a plurality of propeller blades. The propeller hub comprises an outer surface and an inner surface. The propeller blades are extended outwardly from the outer surface of the propeller hub. The marine propeller further comprises at least one adjustable exhaust structure. Each adjustable exhaust structure comprises an exhaust unit cut through the outer surface and inner surface of the propeller hub, an adjustment member mounted in the exhaust unit, and fastening means adapted for locking the adjustment member to the exhaust unit. The exhaust unit comprises at least one exhaust through hole. The adjustment member comprises at least one shielding portion for shielding the at least one exhaust through hole. Further, before the adjustment member is locked to the exhaust unit by the fastening means, the adjustment member is movable relative to the exhaust unit to adjust the shielding area of the at least one shielding portion relative to the at least one exhaust through hole.

Thus, under different application conditions, the user can adjust the exhaust volume to the optimal status without changing any component parts of the marine propeller, enabling the marine propeller to provide a proper speed. Thus, the marine propeller is very convenient to use.

Other advantages and features of the present invention will be fully understood by reference to the following specification in conjunction with the accompanying drawings, in which like reference signs denote like components of structure.

DETAILED DESCRIPTION OF THE INVENTION

Figure 1:
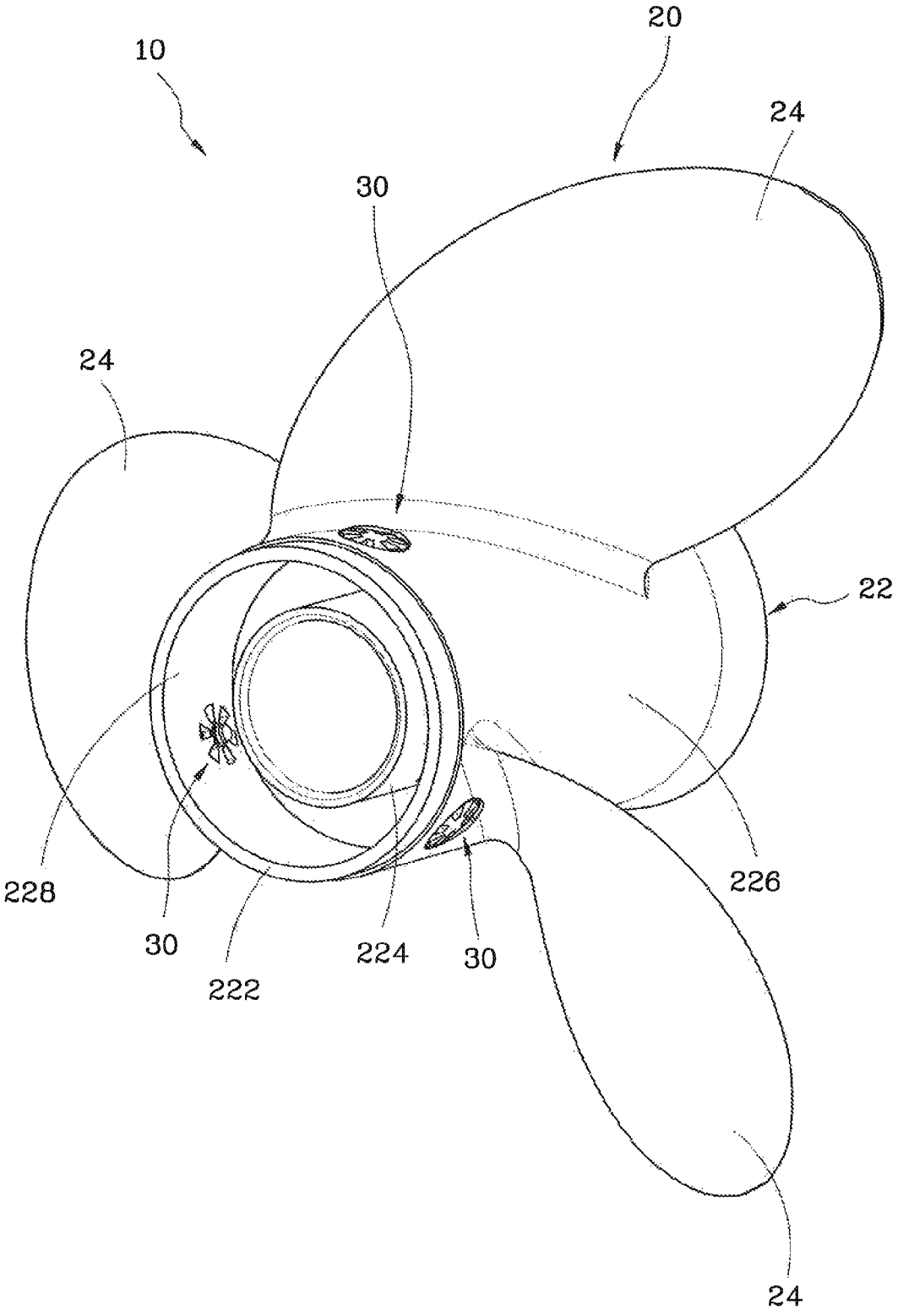
FIG. 1 is an elevational view of a marine propeller with adjustable exhaust means in accordance with a first embodiment of the present invention.
Figure 2:
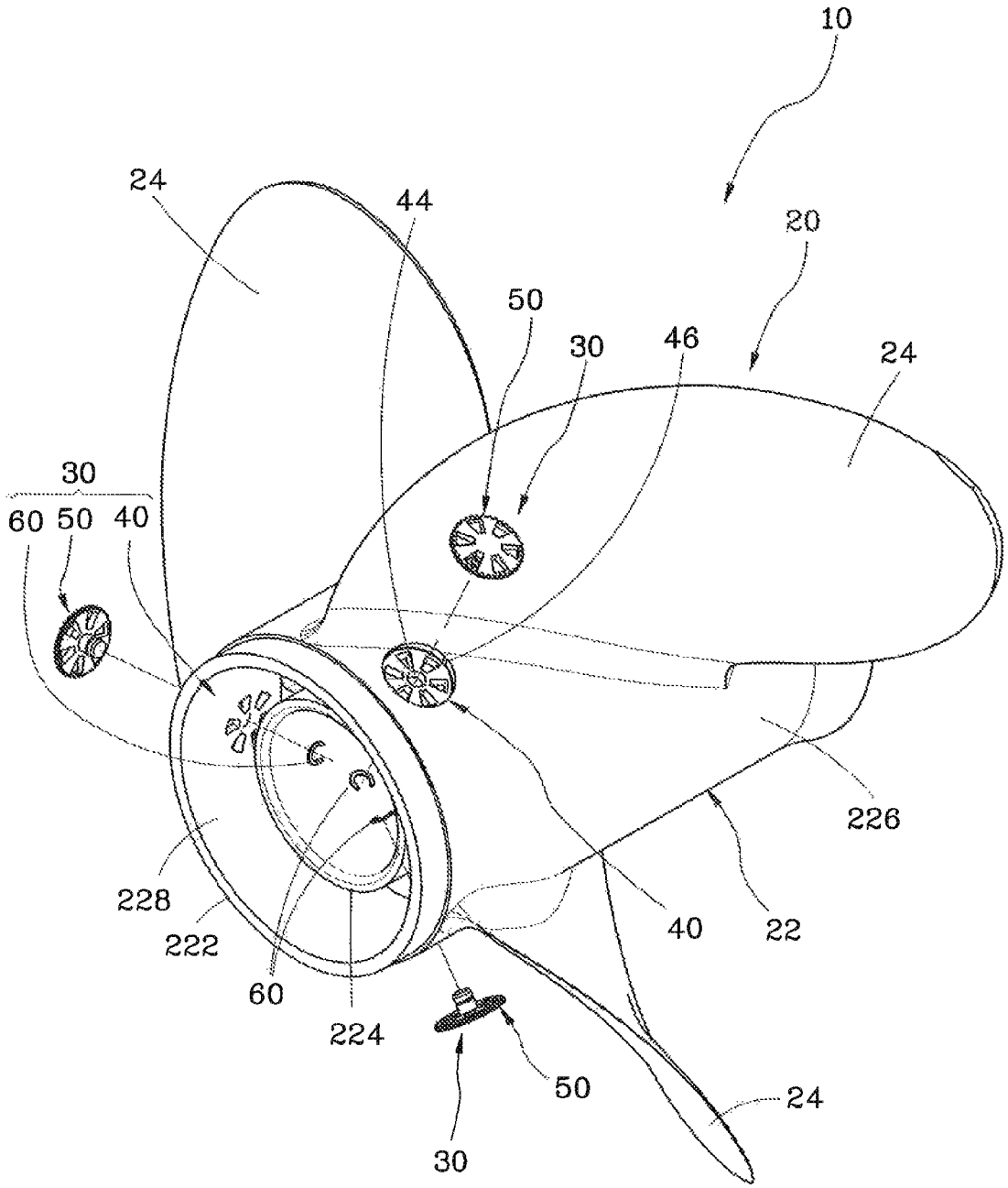
FIG. 2 is an exploded view of the marine propeller with adjustable exhaust means in accordance with the first embodiment of the present invention.

Referring to FIGS. 1 and 2, a marine propeller in accordance with a first embodiment of the present invention is shown. The marine propeller 10 comprises a propeller body 20, and three adjustable exhaust structures 30. Each adjustable exhaust structure 30 comprises an exhaust unit 40 installed in the propeller body 20, an adjustment member 50, and a fastening member 60.

The propeller body 20 comprises a propeller hub 22, and three propeller blades 24. The propeller hub 22 comprises an outer tube 222 and an inner tube 224 integrally formed of multiple rib plates (not shown), and an outer surface 226 and an inner surface 228 located on the outer tube 222. The propeller blades 24 are outwardly extended from the outer surface 226 of the propeller hub 22. The adjustable exhaust structures 30 are respectively disposed between each two adjacent propeller blades 24.

Figure 3:
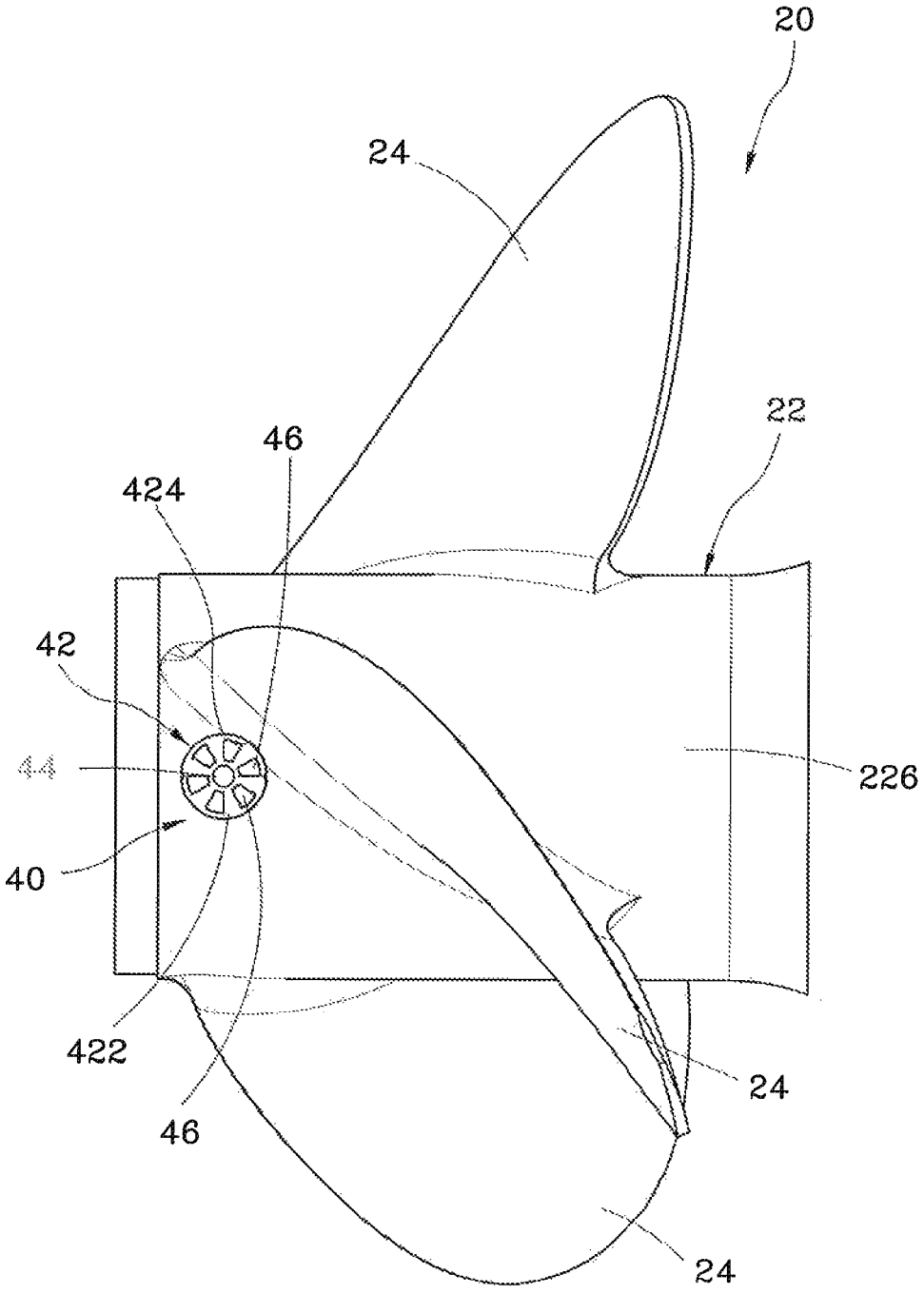
FIG. 3 is a side view of the first embodiment of the present invention, illustrating one exhaust unit in the propeller body of the marine propeller.
Figure 4:
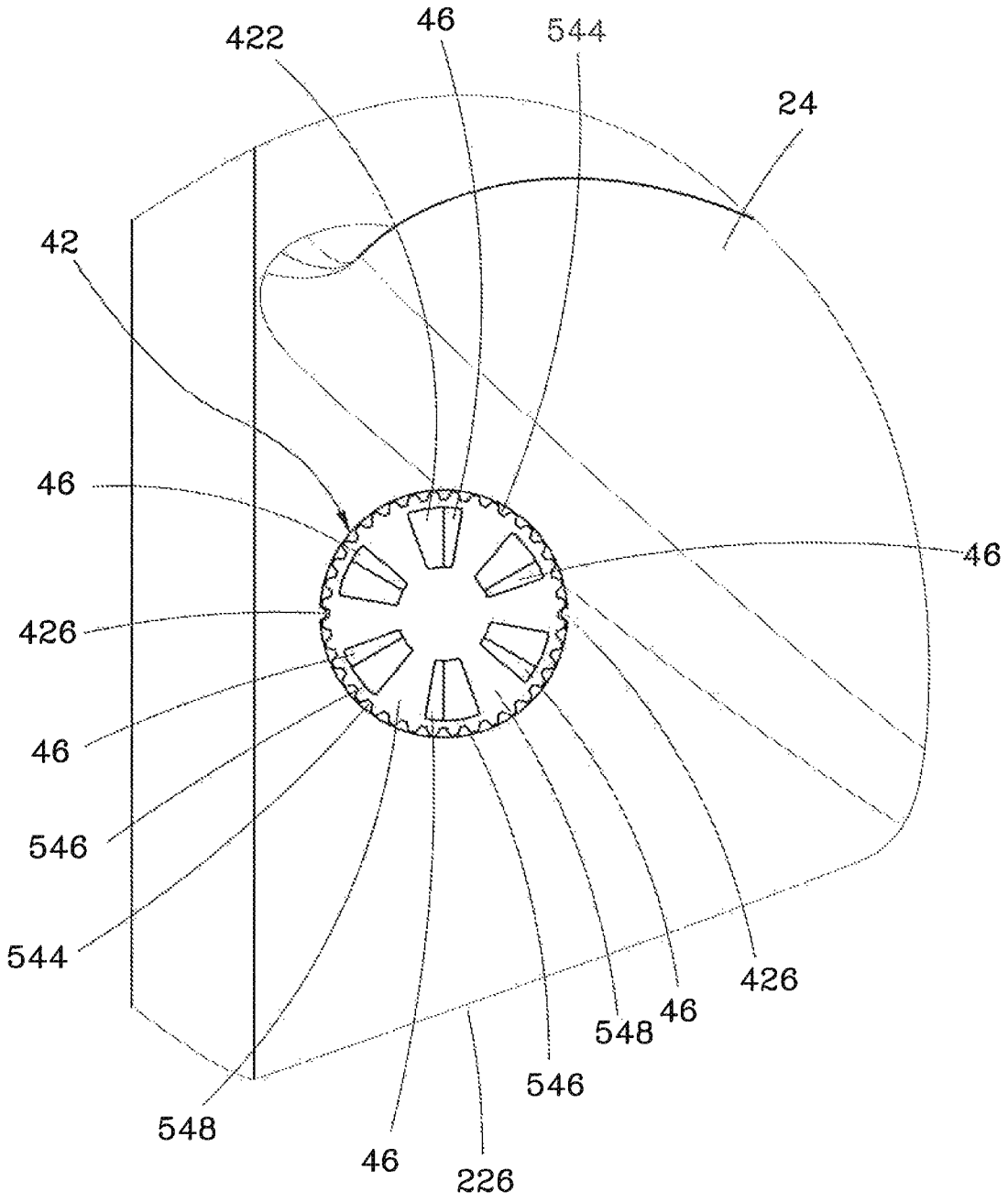
FIG. 4 is an enlarged view of a part of FIG. 3, illustrating one adjustment member installed in the exhaust unit.

Referring to FIGS. 3 and 4 and FIG. 2 again, each exhaust unit 40 comprises a recess 42, an axle hole 44, and six exhaust through holes 46. The recess 42 is located on the outer surface 226, comprising a bottom wall 422, an inner peripheral wall 424, and two blocks 426 protruded from the inner peripheral wall 424. The axle hole 44 and the exhaust through holes 46 extend through the bottom wall 422 of the recess 42 and the inner surface 228 of the propeller hub 22. Further, the exhaust through holes 46 are spaced around the axle hole 44.

Figure 5:
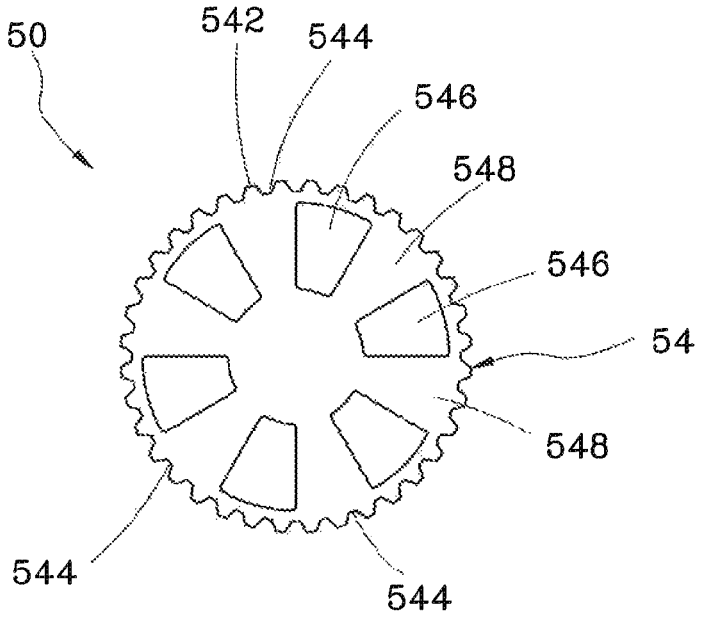
FIG. 5 is an end view of the adjustment member shown in FIG. 4.
Figure 6:
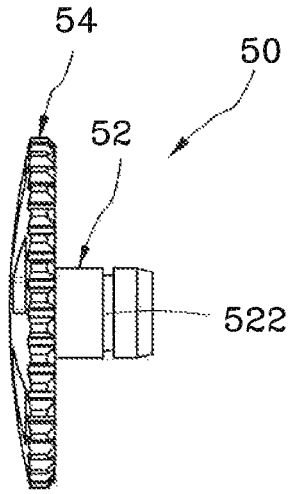
FIG. 6 is a side view of the adjustment member shown in FIG. 4.

Referring to FIGS. 5 and 6, each adjustment member 50 comprises a shaft 52, and an adjustment wheel 54 formed integral with one end of the shaft 52. The shaft 52 comprises a groove 522 extending around the periphery thereof. The adjustment wheel 54 is shaped like a gearwheel, comprising a circular peripheral wall 542, and a plurality of notches 544 arranged around a circle, i.e., equiangularly spaced around the circular peripheral wall 542. The adjustment wheel 54 further comprises six through holes 546 cut through the opposing top and bottom sides thereof and spaced around the shaft 52, and a shielding portion 548 between each two adjacent through holes 546.

Figure 7:
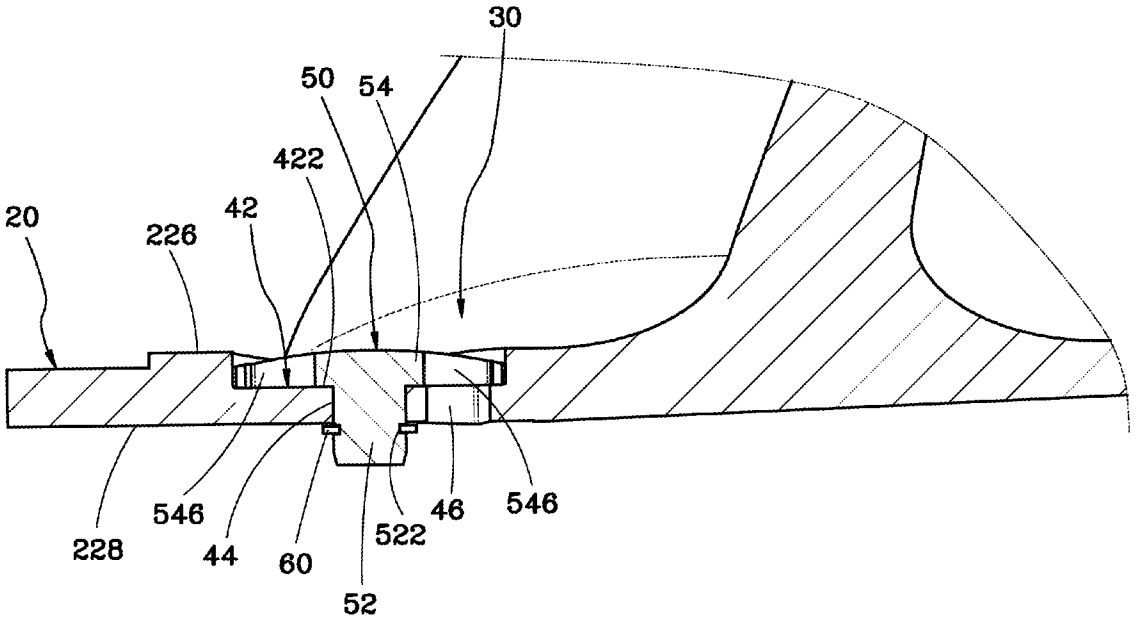
FIG. 7 is a sectional view of the marine propeller with adjustable exhaust means in accordance with the first embodiment of the present invention.

Referring to FIG. 7 and FIGS. 2 and 4 again, in each adjustable exhaust structure 30, the shaft 52 of the adjustment member 50 is inserted into the axle hole 44 of the exhaust unit 40; the adjustment wheel 54 of the adjustment member 50 is set in the recess 42 of the exhaust unit 40; the two blocks 426 of the recess 42 are respectively engaged into one respective notch 544 of the adjustment wheel 54. The fastening member 60 is a C-shaped retaining ring mounted in the groove 522 of the shaft 52 of the adjustment member 50 to stop the adjustment member 50 from escaping out of the exhaust unit 40. The user can detach the fastening member 60, and then remove the adjustment wheel 54 of the adjustment member 50 out of the recess 42, and then rotate the adjustment member 50 to the desired angle, and then set the adjustment wheel 54 of the adjustment member 50 in the recess 42 again, and thus the shielding portions 548 of the adjustment wheel 54 of the adjustment member 50 are moved relative to the exhaust through holes 46 to change their shielding area relative to the exhaust through holes 46 and to further adjust the exhaust volume of the marine propeller 10.

Figure 8:
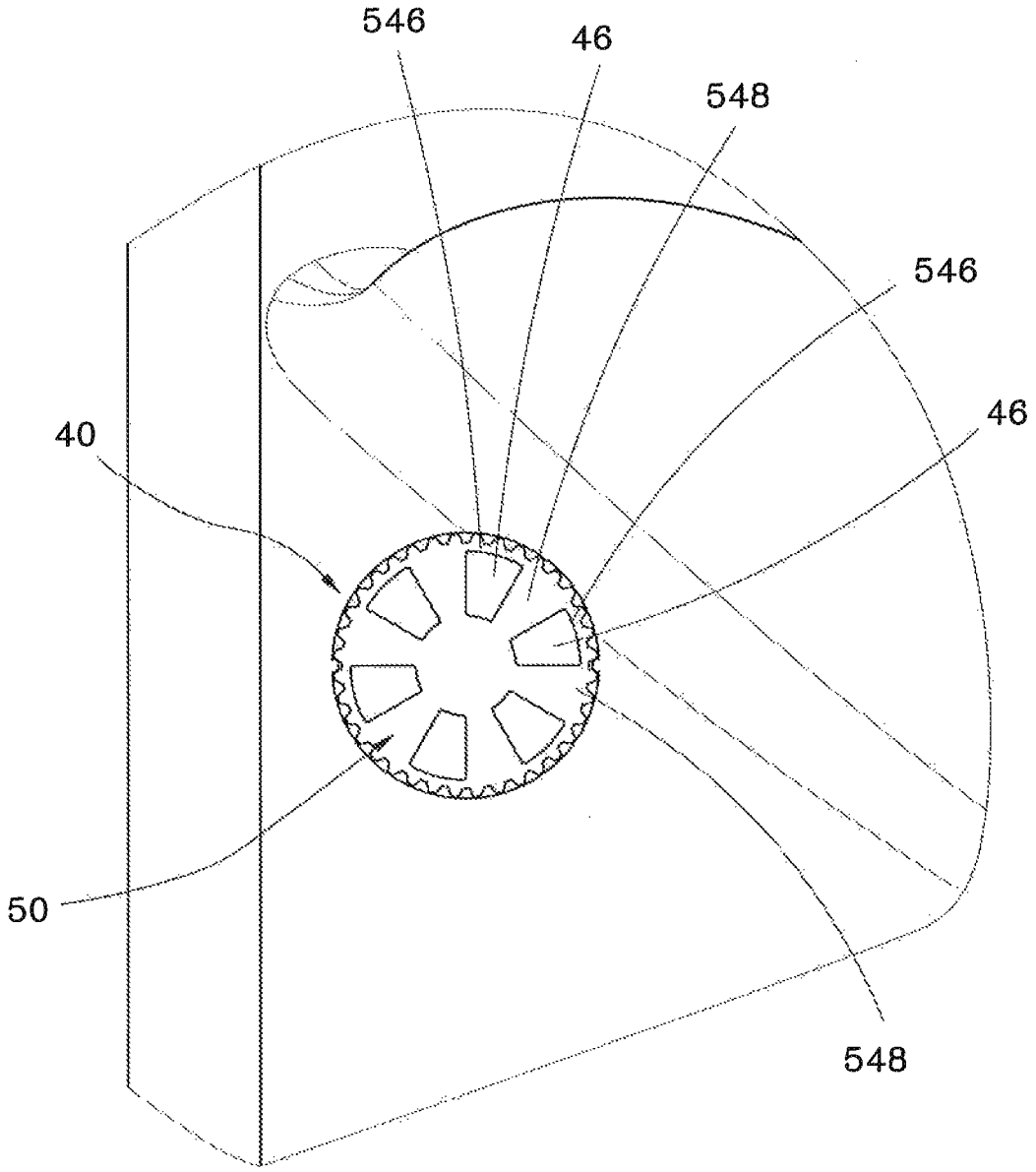
FIG. 8 is similar to FIG. 4 but showing the angular position of the adjustment member adjusted relative to the exhaust unit.
Figure 9:
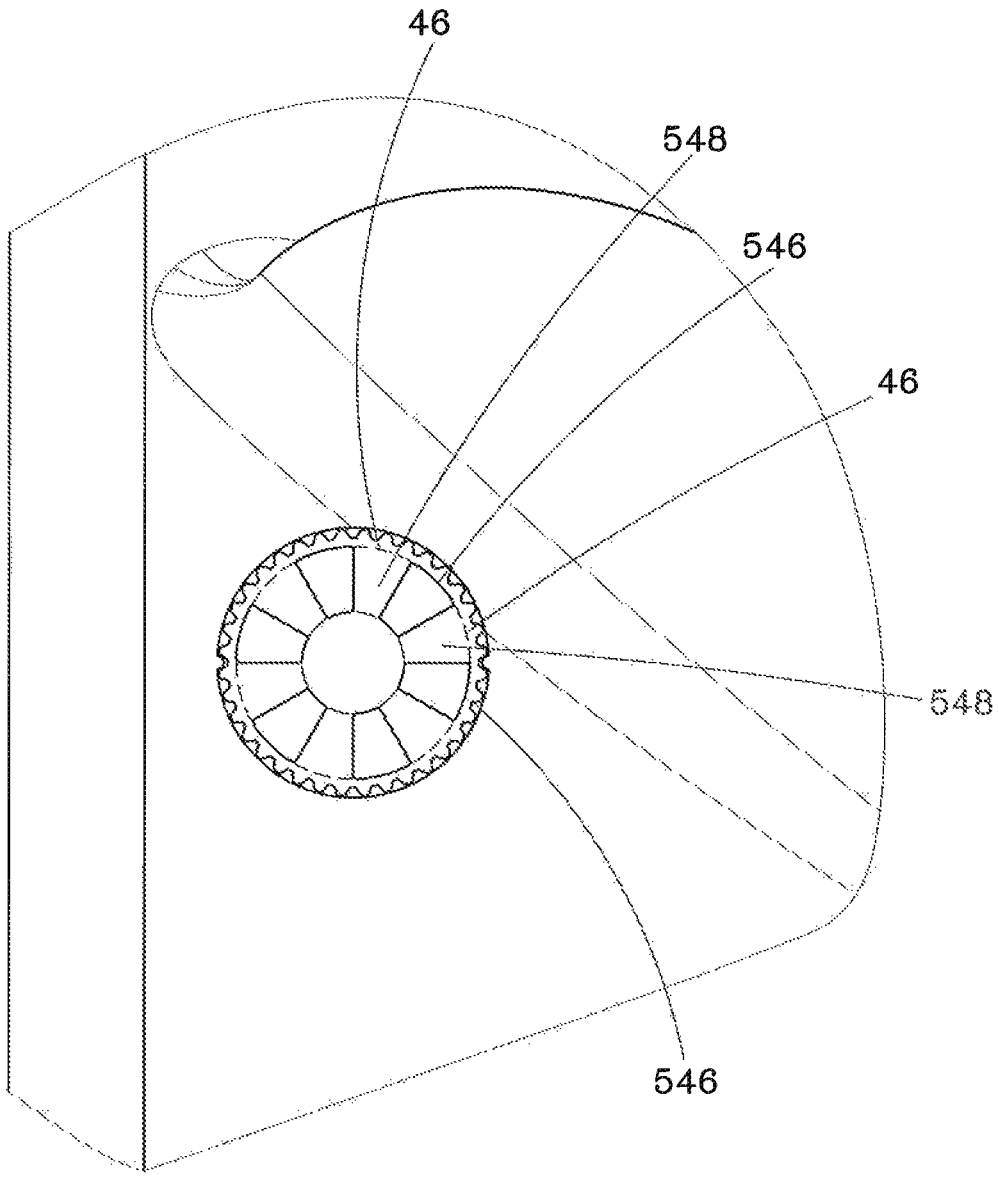
FIG. 9 is similar to FIG. 4 but showing the angular position of the adjustment member adjusted relative to the exhaust unit.

For example, in the configuration shown in FIG. 8, the exhaust through holes 46 of the exhaust unit 40 are not shielded by the shielding portions 548 of the adjustment wheel 54 of the adjustment member 50 and kept in fully communication with the through holes 546. At this time, the exhaust volume of the marine propeller 10 reaches the maximum level. In the configuration shown in FIG. 9, the exhaust through holes 46 of the exhaust unit 40 are fully shielded by the shielding portions 548 of the adjustment wheel 54 of the adjustment member 50 and prohibited from communicating with the through holes 46, and thus the internal gas of the propeller hub 22 cannot be exhausted. At this time, the exhaust volume of the marine propeller 10 reaches the minimum level. Further, the shielding portions 548 of the adjustment wheel 54 of the adjustment member 50 can be moved to partially shield the exhaust through holes 46 of the exhaust unit 40, as shown in FIG. 4. Subject to the aforesaid operation of rotating the adjustment member 50 relative to the exhaust unit 40, the shielded area of the exhaust through holes 46 of the exhaust unit 40 is relatively changed.

In other words, under different application conditions, the user can adjust the exhaust volume to the optimal status without changing any component parts of the marine propeller 10, enabling the marine propeller 10 to provide a proper speed. Thus, the marine propeller 10 is very convenient to use.

It is to be noted that in each of the aforesaid adjustable exhaust structures 30, the fastening member 60 is not limited to C-shaped retaining ring, and any of a variety of other fastening means capable of prohibiting the adjustment member 50 from escaping out of the exhaust unit 40 and allowing movement of the shielding portions 548 of the adjustment wheel 54 of the adjustment member 50 relative to the exhaust through holes 46 of the exhaust unit 40 before fixation can be used as a substitute. Further, two opposite blocks 426 in the recess 42 of each exhaust unit 40 can secure the adjustment member 50 steadily, however, the number and locations of the blocks 426 of the recess 42 of each exhaust unit 40 may be changed without departing from the spirit and scope of the invention. One single block 426 can also achieve the same effect of securing the adjustment member 50 in position.

In the aforesaid first embodiment, the relative positioning between the exhaust unit 40 and the respective adjustment member 50 and quantitative adjustment of the relative angle therebetween are achieved by means of selectively engaging the relative smaller number of the blocks 426 of the exhaust unit 40 into the relatively larger number of the notches 544 of the adjustment member 50. Alternatively, the adjustment member 50 can be made having a relatively smaller number of blocks for selectively engaging a relatively larger number of notches in the exhaust unit 40. Further, it is not a limitation to arrange the notches around a circle.

Further, the number and arrangement of the exhaust through holes 46 of the exhaust unit 40 and the number and arrangement of the through holes 546 and shielding portions 548 of each adjustment member 50 are not limited to the aforesaid design. Actually, each adjustable exhaust structure 30 can be made having at least one set of exhaust through holes 46, through holes 546 and shielding portions 548 to achieve the same effects. Hereinafter, another embodiment will be further described.

The marine propeller 10 can be made having at least one adjustable exhaust structure 30 to achieve the aforesaid exhaust volume adjustment effect. However, arranging one adjustable exhaust structure 30 between each two adjacent propeller blades 24 can balance the resistance of the propeller blades 24, facilitating smooth operation of the marine propeller 10.

Figure 10:
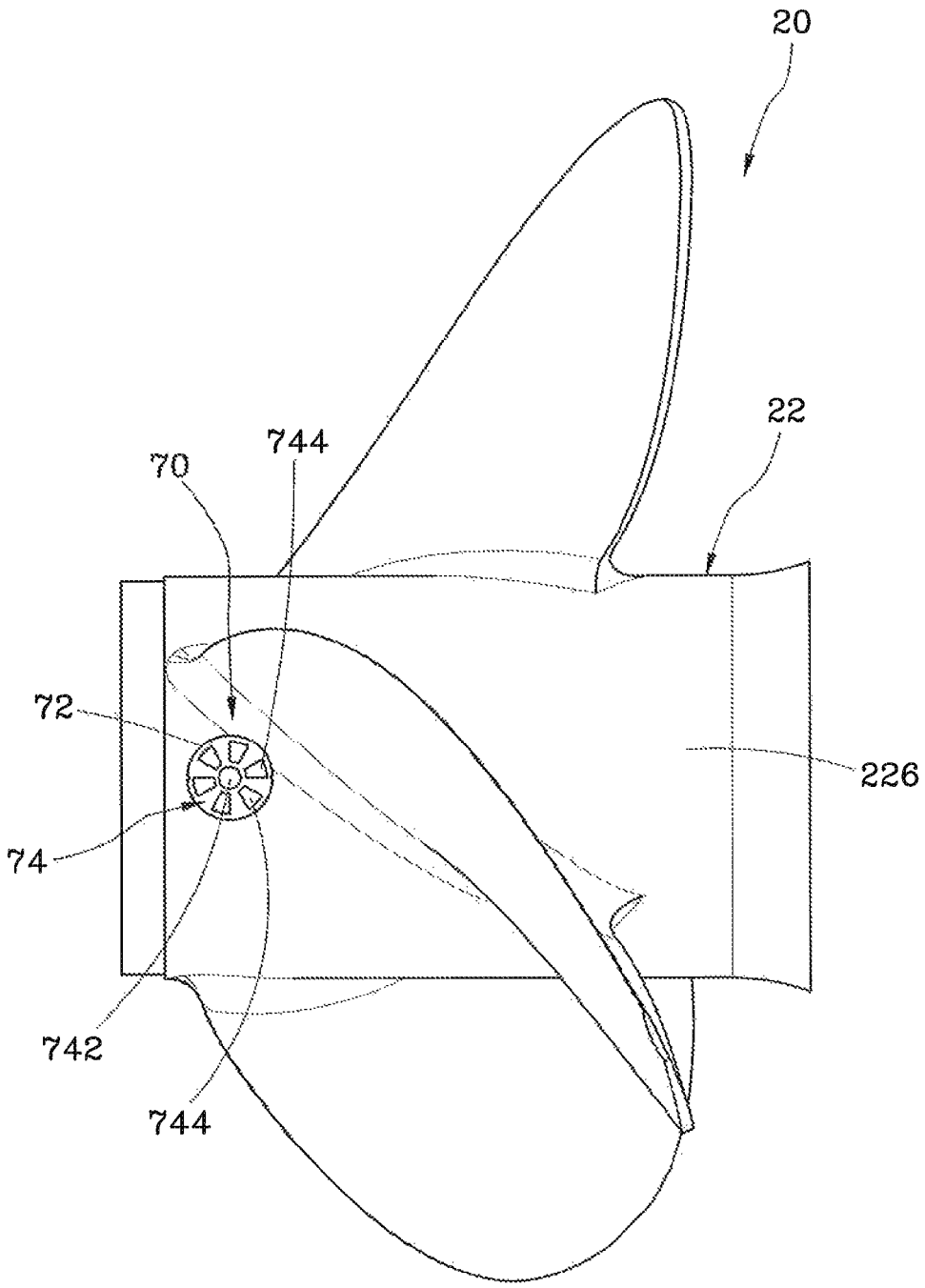
FIG. 10 is a side view of a marine propeller with adjustable exhaust means in accordance with a second embodiment of the present invention, illustrating one exhaust unit in a propeller body.
Figure 11:
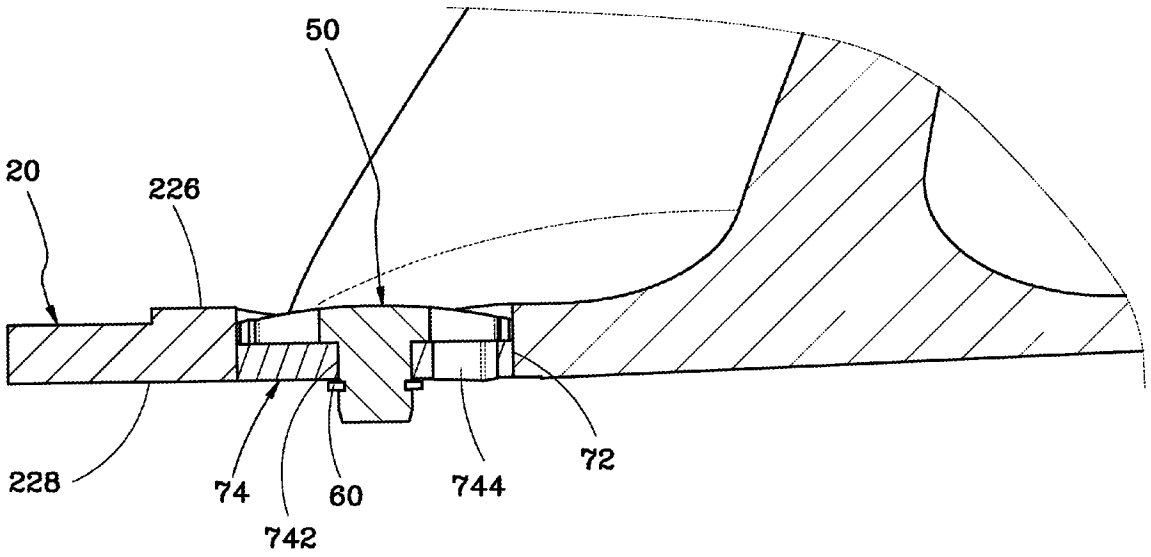
FIG. 11 is a sectional view of the marine propeller with adjustable exhaust means in accordance with the second embodiment of the present invention.

In the aforesaid first embodiment, the recess 42, axle hole 44 and exhaust through holes 46 of the exhaust unit 40 are located on the propeller body 20, however, this arrangement is not a limitation. In a second embodiment of the present invention as shown in FIGS. 10 and 11, the exhaust unit 70 of the marine propeller comprises a through hole 72 extending through the outer surface 226 and inner surface 228 of the propeller hub 22 of the propeller body 20, and a plug 74 fixedly mounted in the through hole 72. The plug 72 defines an axle hole 742, and a plurality of exhaust through holes 744. Thus, this exhaust unit 70 achieves the same effects as the exhaust unit 40 of the aforesaid first embodiment.

Figure 12:
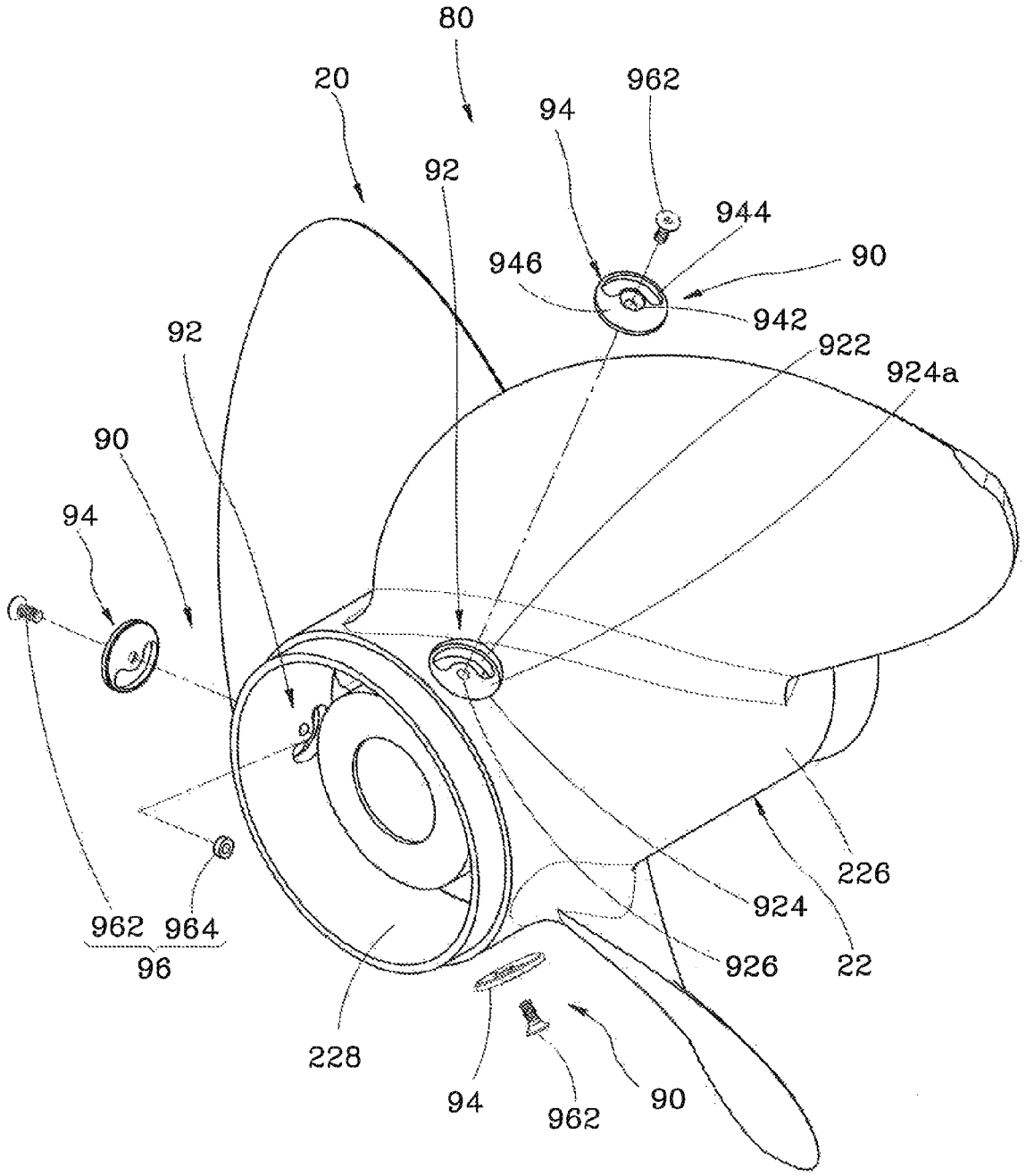
FIG. 12 is an exploded view of a marine propeller with adjustable exhaust means in accordance with a third embodiment of the present invention.

Referring to FIG. 12, a marine propeller with adjustable exhaust means in accordance with a third embodiment of the present invention is shown. The marine propeller 80 of this third embodiment is substantially similar to the marine propeller 10 of the aforesaid first embodiment with the exception that the exhaust unit 90 of each adjustable exhaust structure 90 of the marine propeller 80 simply comprises one single exhaust through hole 922, and the fastening means 96 of the each adjustable exhaust structure 90 for securing the adjustment member 94 to the propeller body 20 is different from that used in the marine propeller 10.

More specifically, each exhaust unit 92 comprises a recess 924 located at the outer surface 226 of the propeller hub 22, an axle hole 926 cutting through the bottom wall 924*a* of the recess 924 and the inner surface 228 of the propeller hub 22 and the aforesaid exhaust through hole 922. Further, the exhaust through hole 922 is an arched through hole 922 extending around the axle hole 926. The adjustment member 94 is shaped like a disk comprising a countersunk hole 942, an arched through hole 944 extending around the countersunk hole 942, and a shielding portion 946. The fastening means 96 comprises a screw 962, and a nut 964.

Figure 13:
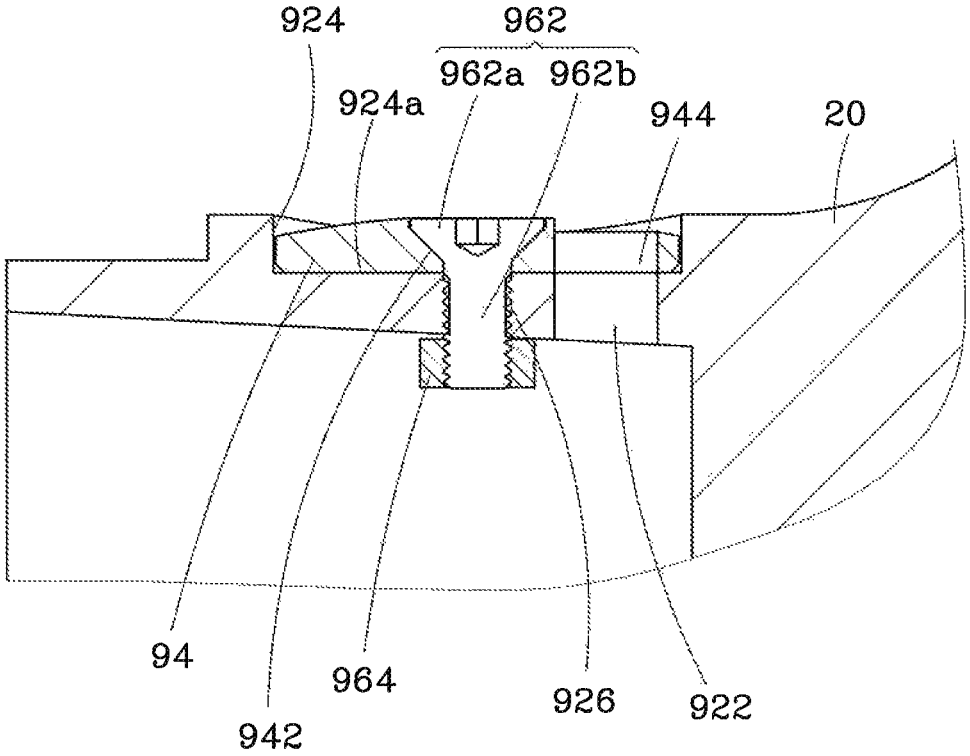
FIG. 13 is a partial sectional view, in an enlarged scale, of the marine propeller with adjustable exhaust means in accordance with the third embodiment of the present invention.

As illustrated in FIG. 13, the adjustment member 94 is mounted in the recess 924. The screw 962 comprises a head 962*a* and a threaded shank 962*b* respectively mounted in the countersunk hole 942 and the axle hole 926. Thus, the adjustment member 94 is linked to the propeller body 20 by the screw 962. The nut 964 is threaded onto the screw 962 to secure the adjustment member 94 to the propeller body 20.

Figure 14:
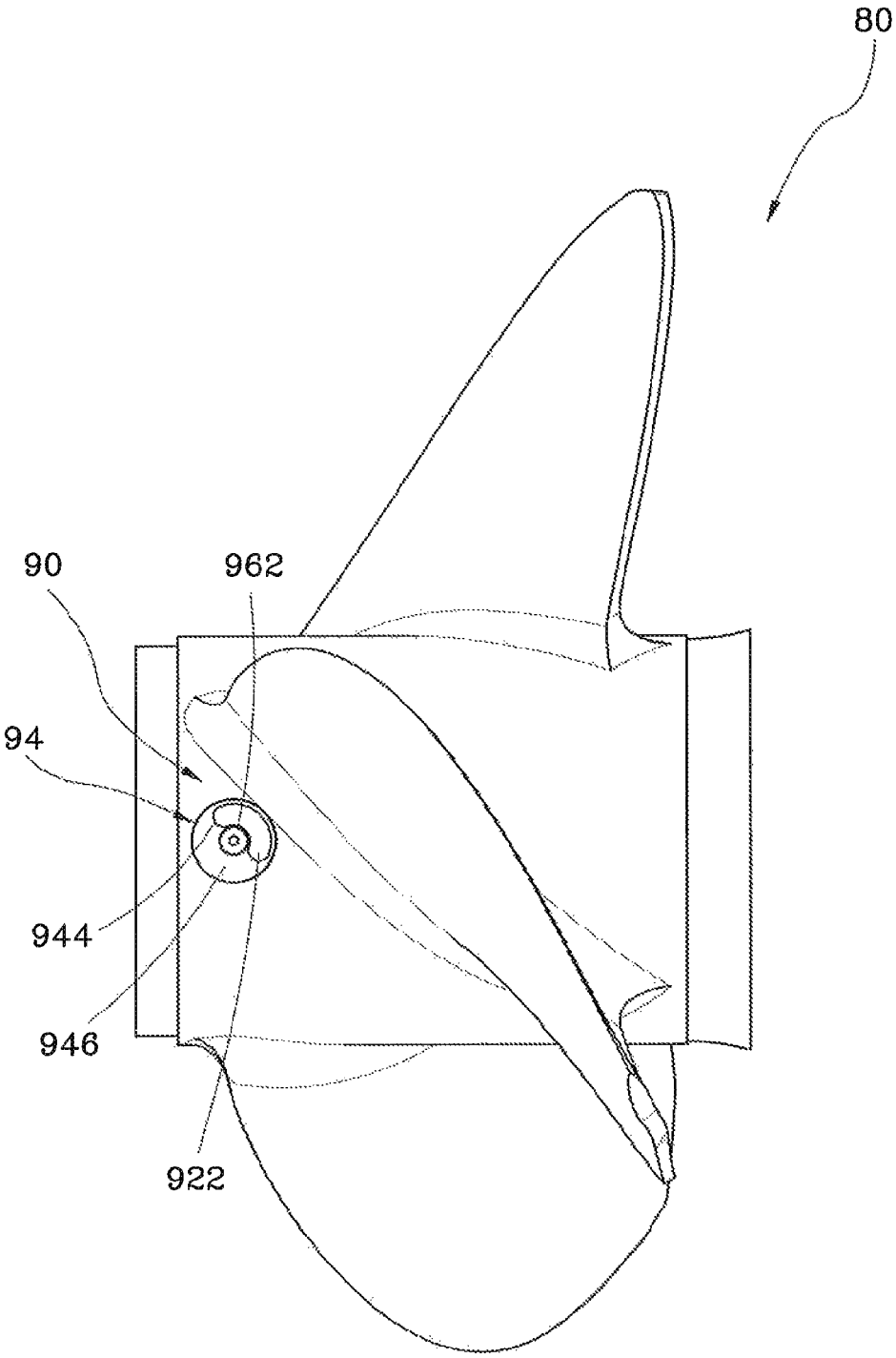
FIG. 14 is a side view of the marine propeller with adjustable exhaust means in accordance with the third embodiment of the present invention, illustrating the exhaust through hole in fully communication with the through hole of the adjustment member.
Figure 15:
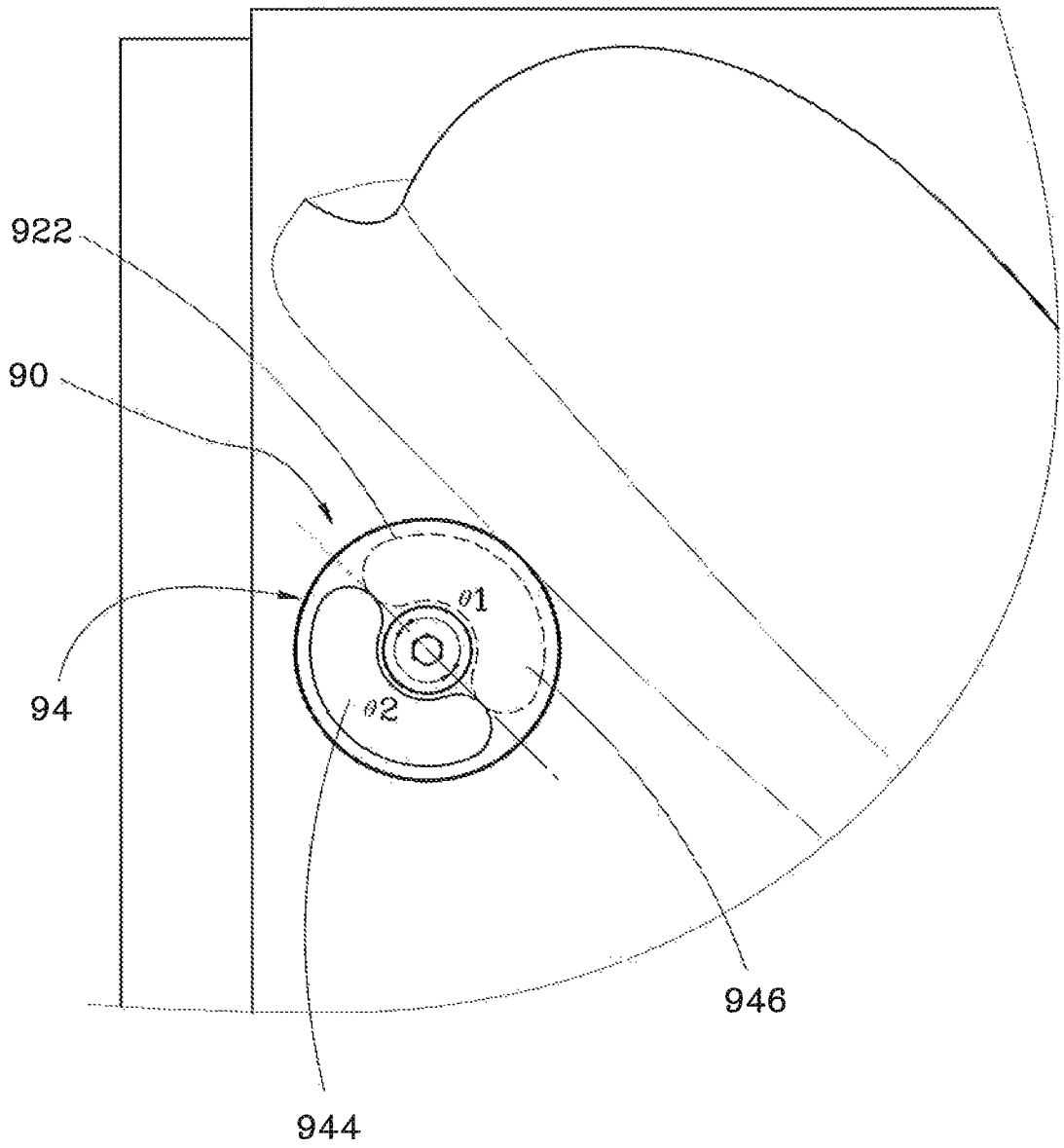
FIG. 15 is a schematic side view of a part of the marine propeller with adjustable exhaust means in accordance with the third embodiment of the present invention, illustrating the exhaust through hole completely shielded by the adjustment member.
Figure 16:
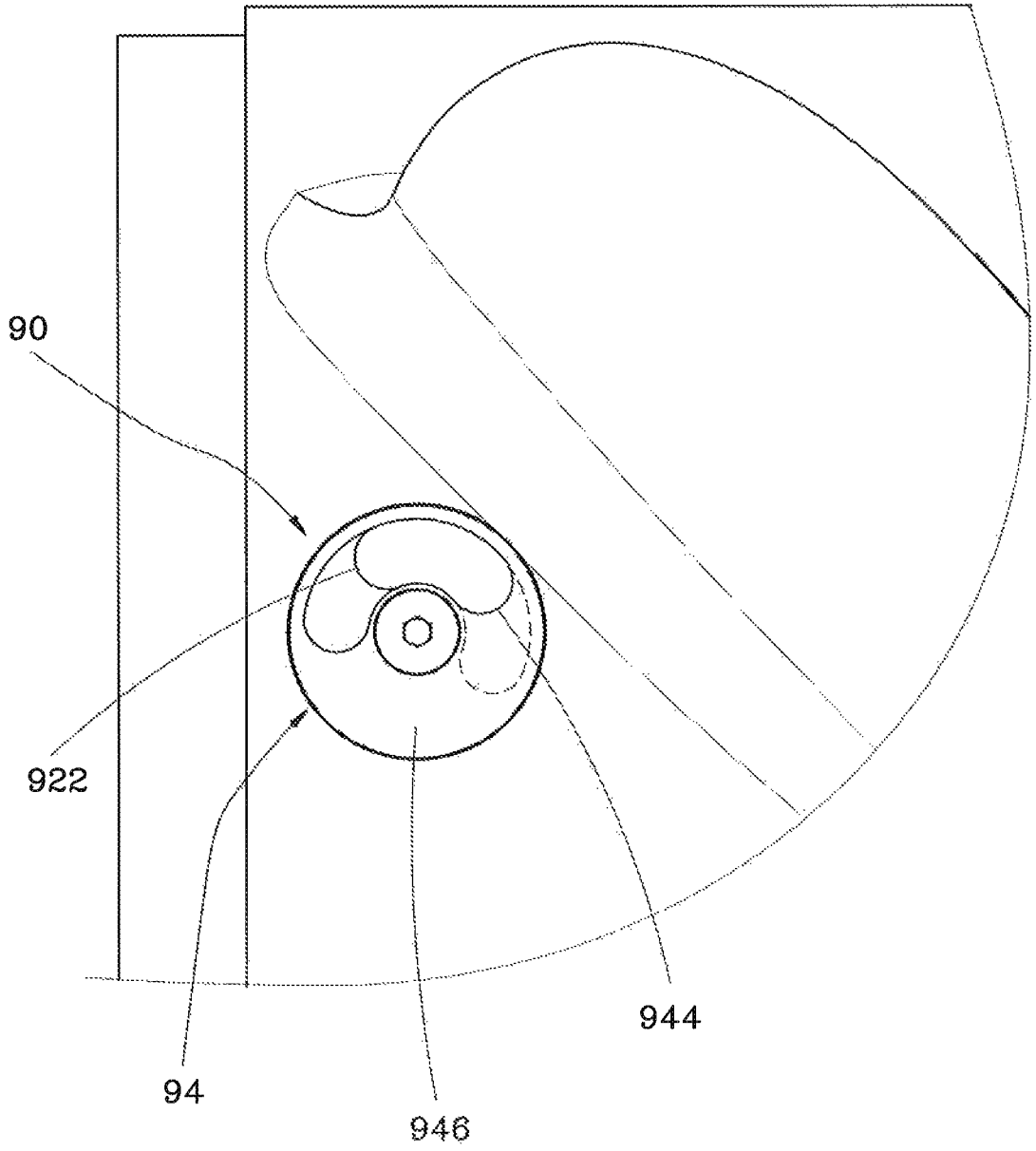
FIG. 16 corresponds to FIG. 15, illustrating the exhaust through hole partially shielded by the adjustment member.

As illustrated in FIGS. 14-16, when the nut 964 and the screw 962 are not fastened tight, the adjustment member 94 can be rotated relative to the propeller body 20 for enabling the shielding portion 946 to be moved relative to the exhaust through hole 922 to adjust the shielding area of the shielding portion 946 on the exhaust through hole 922. In other words, after loosened the nut 964, the user can then rotate the adjustment member 94 to adjust the shielding area of the shielding portion 946 on the exhaust through hole 922, and then fasten tight the nut 964 after the adjustment. Thus, the adjustment of the exhaust volume of the marine propeller is very convenient.

As illustrated in FIG. 15, in this embodiment, the exhaust through hole 922 of each adjustable exhaust structure 90 and the arched through hole 944 of the adjustment member 94 respectively define a 180° central angle $\theta_1$ or $\theta_2$. Thus, rotating the adjustment member 94 can let the arched through hole 944 be in fully communication with the exhaust through hole 922 (see FIG. 14), or let the exhaust through hole 922 be completely shield by the shielding portion 946 (see FIG. 15), enabling the marine propeller 80 to provide a maximum adjustment range.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A marine propeller comprising a propeller body, said propeller body comprising a propeller hub and a plurality of propeller blades, said propeller hub comprising an outer surface and an inner surface, said propeller blades being extended outwardly from said outer surface of said propeller hub, wherein:

said marine propeller further comprises: at least one adjustable exhaust structure, said adjustable exhaust structure comprising an exhaust unit cut through said outer surface and said inner surface of said propeller hub, an adjustment member mounted in said exhaust unit, and fastening means for locking said adjustment member to said exhaust unit, said exhaust unit comprising an exhaust through hole, said adjustment member comprising a shielding portion for shielding said exhaust through hole, said adjustment member being movable relative to said exhaust unit to adjust a shielding area of said shielding portion relative to said exhaust through hole before being locked to said exhaust unit by said fastening means;

wherein said fastening means of each said adjustable exhaust structure comprises a screw and a nut, said screw being adapted to link said adjustment member to said propeller body, said nut being threaded onto said screw to lock said adjustment member to said propeller body;

wherein the adjustment hole unit of each said adjustable exhaust structure comprises only one said exhaust through hole and the exhaust through hole is arch-shaped; and wherein said exhaust through hole of each said adjustable exhaust structure and said arched through hole of said adjustment member respectively define a 180° central angle.

2. The marine propeller as claimed in claim 1, wherein the adjustment member of each said adjustable exhaust structure comprises an arched through hole completely kept in communication with said exhaust through hole.

3. The marine propeller as claimed in claim 1, wherein said exhaust unit of each said adjustable exhaust structure further comprises an axle hole; said fastening means comprises a screw and a nut, said screw being inserted through said axle hole to link said adjustment member to said propeller body, said nut being fastenable to said screw to lock said adjustment member to said propeller body, said adjustment member being rotatable relative to said propeller body to change the shielding area of said shielding portion on said exhaust through hole after said nut is loosened from said screw.

4. The marine propeller as claimed in claim 3, wherein the adjustment member of each said adjustable exhaust structure comprises a countersunk hole; said screw comprises a head positioned in said countersunk hole, and a threaded shank extended from said head and mounted in said axle hole.

5. The marine propeller as claimed in claim 3, wherein said exhaust unit of each said adjustable exhaust structure further comprises a recess located on said outer surface of said propeller hub, said recess defining a bottom wall; said axle hole and said exhaust through hole extend through said bottom wall and said inner surface; said adjustment member is mounted in said recess.

* * * * *